US006267235B1

(12) United States Patent
Matias et al.

(10) Patent No.: US 6,267,235 B1
(45) Date of Patent: Jul. 31, 2001

(54) GOLFING TEE SYSTEM

(76) Inventors: Melchor Matias; Aida Matias, both of 57-31 256th St., Little Neck, NY (US) 11362

( * ) Notice: Subject to any disclaimer, the term of this patent is extended or adjusted under 35 U.S.C. 154(b) by 0 days.

(21) Appl. No.: 09/557,191

(22) Filed: Apr. 21, 2000

(51) Int. Cl.[7] ..... B65D 85/20
(52) U.S. Cl. ..... 206/315.1; 473/391
(58) Field of Search ..... 206/315.1, 315.2, 206/315.3–315.5; 473/386, 387, 406, 391

(56) References Cited

U.S. PATENT DOCUMENTS

| | | | | |
|---|---|---|---|---|
| 43,494 | | 7/1864 | Harvey . | |
| D. 91,149 | | 12/1933 | Thompson . | |
| 1,703,139 | * | 2/1929 | Falcone et al. | 206/315.1 |
| 3,272,412 | * | 9/1966 | Antonious | 206/315.1 |
| 4,151,937 | * | 5/1979 | Jarosh et al. | 206/315.1 |
| 4,573,610 | | 3/1986 | Hurner . | |
| 4,875,579 | | 10/1989 | Tak . | |
| 5,158,179 | * | 10/1992 | Gosselin | 206/315.1 |
| 5,372,362 | * | 12/1994 | Barker | 473/406 |
| 5,571,055 | | 11/1996 | Lewis et al. . | |
| 5,642,809 | * | 7/1997 | Mayville | 206/315.1 |
| 5,672,122 | | 9/1997 | Strong . | |
| 5,759,119 | | 6/1998 | Ayoub . | |

* cited by examiner

*Primary Examiner*—Luan K. Bui
(74) *Attorney, Agent, or Firm*—Goldstein Law Offices P.C

(57) ABSTRACT

A golfing tee system including a plurality of tees of varying lengths. Each of the tees have a lower ground penetrating portion. The lower ground penetrating portion has a pointed lower end and an upper end. Each of the tees have a circular disk secured to the upper end of the lower ground penetrating portion. Each of the tees have an upper cylindrical portion. The upper cylindrical portion has a wide upper portion and a narrow lower portion. The narrow lower portion is secured to and extends upwardly from the circular disk. The wide upper portion has a concave upper end. The concave upper end is adapted for receiving a golf ball thereon.

2 Claims, 2 Drawing Sheets

Fig. 1
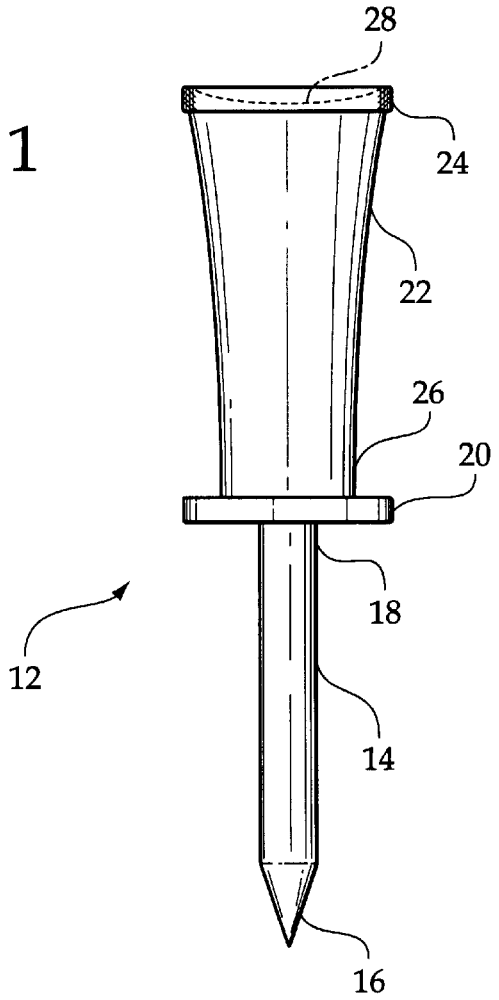
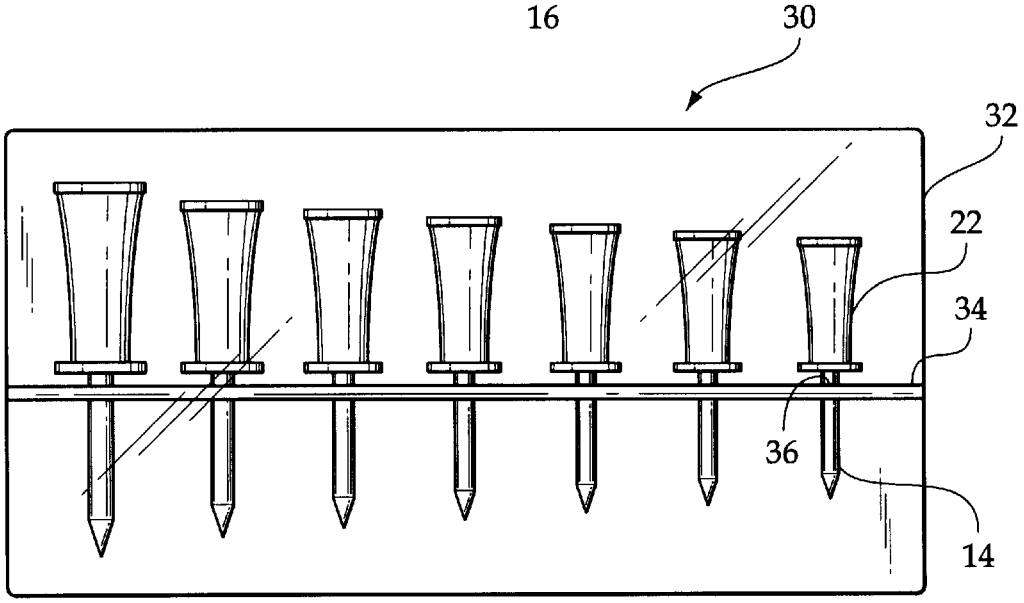
Fig. 2

GOLFING TEE SYSTEM

BACKGROUND OF THE INVENTION

The present invention relates to a golfing tee system and more particularly pertains to making the teeing of a golf ball easier and more efficient.

The use of golf devices is known in the prior art. More specifically, golf devices heretofore devised and utilized for the purpose of aiding golfers in playing golf are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,672,122 to Strong discloses a golf tee with notches to accommodate various positions. U.S. Pat. No. 5,571,055 to Lewis discloses a golf tee with a non-adjustable base incorporated for anchoring the device in the ground. U.S. Pat. No. 5,759,119 to Ayoub discloses a golf tee with a circular support piece incorporated. U.S. Pat. No. Des. 91,149 to Thompson discloses an ornamental design for a golf tee. U.S. Pat. No. 4,875,579 to Tak and U.S. Pat. No. 4,573,610 to Hurner disclose various golf tee containers and dispenser devices.

While these devices fulfill their respective, particular objective and requirements, the aforementioned patents do not describe a golfing tee system for making the teeing of a golf ball easier and more efficient.

In this respect, the golfing tee system according to the present invention substantially departs from the conventional concepts and designs of the prior art, and in doing so provides an apparatus primarily developed for the purpose of making the teeing of a golf ball easier and more efficient.

Therefore, it can be appreciated that there exists a continuing need for a new and improved golfing tee system which can be used for making the teeing of a golf ball easier and more efficient. In this regard, the present invention substantially fulfills this need.

SUMMARY OF THE INVENTION

In the view of the foregoing disadvantages inherent in the known types of golf devices now present in the prior art, the present invention provides an improved golfing tee system. As such, the general purpose of the present invention, which will be described subsequently in greater detail, is to provide a new and improved golfing tee system which has all the advantages of the prior art and none of the disadvantages.

To attain this, the present invention essentially comprises a plurality of tees of varying lengths. Each of the tees have a lower ground penetrating portion. The lower ground penetrating portion has a pointed lower end and an upper end. Each of the tees have a circular disk secured to the upper end of the lower ground penetrating portion. Each of the tees have an upper cylindrical portion. The upper cylindrical portion has a wide upper portion and a narrow lower portion. The narrow lower portion is secured to and extends upwardly from the circular disk. The wide upper portion has a concave upper end. The concave upper end is adapted for receiving a golf ball thereon. A carrying case is provided that is adapted for holding all of the plurality of tees therein. The carrying case is comprised of a pliable plate. The plate has single strap extending a length thereof. The strap has a plurality of apertures therethrough in a spaced relationship. The plurality of apertures receive the lower ground penetrating portions of the tees therein. A carrying container is provided that is adapted for holding one of the plurality of tees. The carrying container has a hollow interior dimensioned for receiving any one of the plurality of tees therein. The carrying container has an open upper end in communication with the hollow interior. The carrying container includes a cap portion adapted for coupling therewith. The cap portion has an open lower end for coupling with the open upper end of the carrying container. The cap portion has an extended upper end. The extended upper end has an aperture therethrough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golfing tee system which has all the advantages of the prior art golf devices and none of the disadvantages.

It is another object of the present invention to provide a new and improved golfing tee system which may be easily and efficiently manufactured and marketed.

It is a further object of the present invention to provide a new and improved golfing tee system which is of durable and reliable construction.

An even further object of the present invention is to provide a new and improved golfing tee system which is susceptible of a low cost of manufacture with regard to both materials and labor, and which accordingly is then susceptible of low prices of sale to the consuming public, thereby making such a golfing tee system economically available to the buying public.

Even still another object of the present invention is to provide a new and improved golfing tee system for making the teeing of a golf ball easier and more efficient.

Lastly, it is an object of the present invention to provide a new and improved golfing tee system including a plurality of tees of varying lengths. Each of the tees have a lower ground penetrating portion. The lower ground penetrating portion has a pointed lower end and an upper end. Each of the tees have a circular disk secured to the upper end of the lower ground penetrating portion. Each of the tees have an upper cylindrical portion. The upper cylindrical portion has a wide upper portion and a narrow lower portion. The narrow lower portion is secured to and extends upwardly from the circular disk. The wide upper portion has a concave upper end. The concave upper end is adapted for receiving a golf ball thereon. These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of the preferred embodiment of the golfing tee system constructed in accordance with the principles of the present invention.

FIG. 2 is a front view of the plurality of tees of the present invention.

The same reference numerals refer to the same parts through the various figures.

DESCRIPTION OF THE PREFERRED EMBODIMENT

Figure 3:
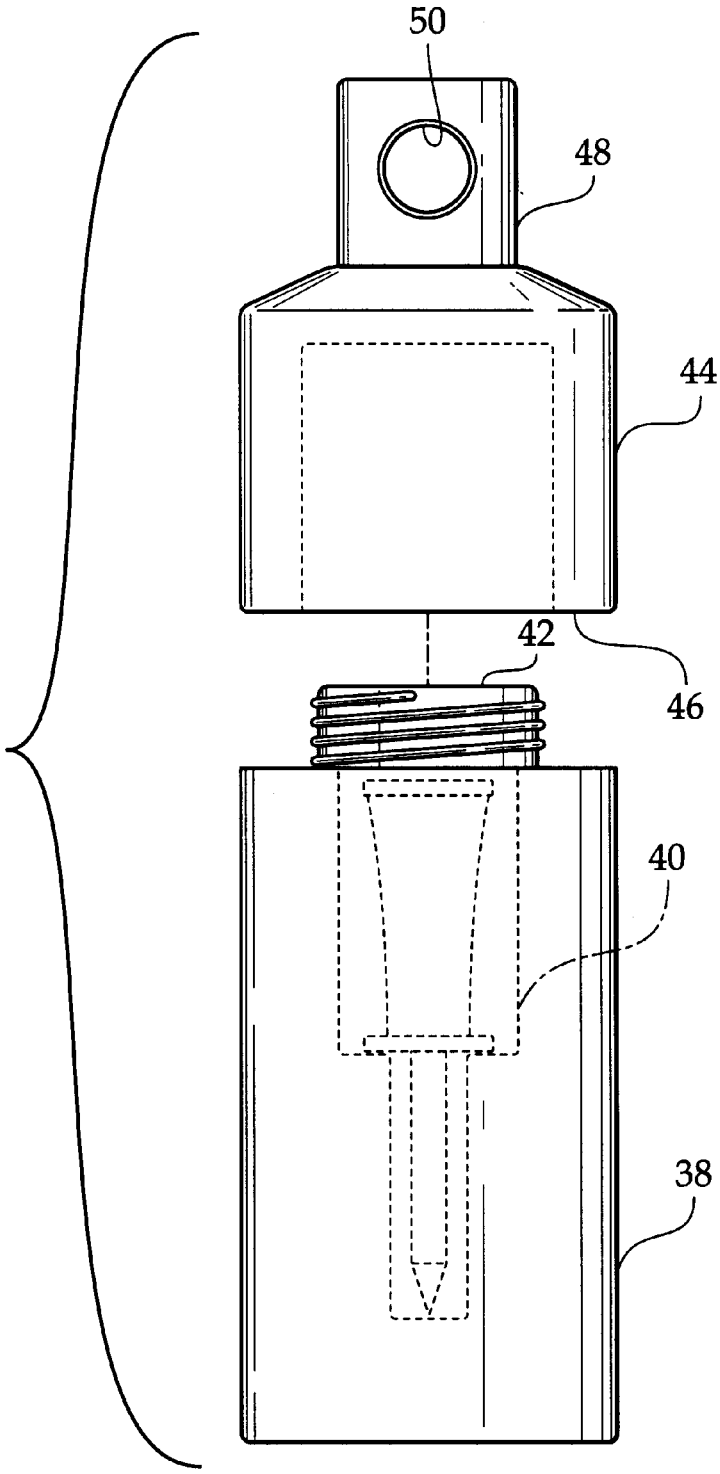
FIG. 3 is a front view of the single tee container of the present invention.

With reference now to the drawings, and in particular, to FIGS. 1 through 3 thereof, the preferred embodiment of the new and improved golfing tee system embodying the principles and concepts of the present invention will be described.

Specifically, it will be noted in the various Figures that the device relates to a golfing tee system for making the teeing of a golf ball easier and more efficient. In its broadest context, the device consists of a plurality of tees, a carrying case, and a carrying container. Such components are individually configured and correlated with respect to each other so as to attain the desired objective.

The plurality of tees 12 are of varying lengths. Note FIGS. 1 and 2. Each of the tees 12 have a lower ground penetrating portion 14. The lower ground penetrating portion 14 has a pointed lower end 16 and an upper end 18. Each of the tees 12 have a circular disk 20 secured to the upper end 18 of the lower ground penetrating portion 14. The circular disk 20 will serve to stabilize the tee 12 once the lower ground penetrating portion 14 has been inserted into the ground. Each of the tees 12 have an upper cylindrical portion 22. The upper cylindrical portion 22 has a wide upper portion 24 and a narrow lower portion 26. The narrow lower portion 26 is secured to and extends upwardly from the circular disk 20. The wide upper portion 24 has a concave upper end 28. The concave upper end 28 is adapted for receiving a golf ball thereon.

The carrying case 30 is adapted for holding all of the plurality of tees 12 therein. Note FIG. 2. The carrying case 30 is comprised of a pliable plate 32. The plate 32 has single strap 34 extending a length thereof. The strap 34 has a plurality of apertures 36 therethrough in a spaced relationship. The plurality of apertures 36 receive the lower ground penetrating portions 14 of the tees 12 therein. The carrying case 30 can be folded up for carrying in the golfer's pocket or the like.

The carrying container 38 is adapted for holding one of the plurality of tees 12. Note FIG. 3. The carrying container 38 has a hollow interior 40 dimensioned for receiving any one of the plurality of tees 12 therein. The carrying container 38 has an open upper end 42 in communication with the hollow interior 40. The carrying container 38 includes a cap portion 44 adapted for coupling therewith. The cap portion 44 has an open lower end 46 for coupling with the open upper end 42 of the carrying container 38. The cap portion 44 has an extended upper end 48. The extended upper end 48 has an aperture 50 therethrough.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A golfing tee system for making the teeing of a golf ball easier and more efficient comprising, in combination:

a plurality of tees of varying lengths, each of the tees having a lower ground penetrating portion, the lower ground penetrating portion having a pointed lower end and an upper end, each of the tees having a circular disk secured to the upper end of the lower ground penetrating portion, each of the tees having an upper cylindrical portion, the upper cylindrical portion having a wide upper portion and a narrow lower portion, the narrow lower portion secured to and extending upwardly from the circular disk, the wide upper portion having a concave upper end, the concave upper end adapted for receiving a golf ball thereon;

a carrying case adapted for holding all of the plurality of tees therein, the carrying case being comprised of a pliable plate, the plate having single strap extending a length thereof, the strap having a plurality of apertures therethrough in a spaced relationship, the plurality of apertures receiving the lower ground penetrating portions of the tees therein;

a carrying container adapted for holding one of the plurality of tees, the carrying container having a hollow interior dimensioned for receiving any one of the plurality of tees therein, the carrying container having an open upper end in communication with the hollow interior, the carrying container including a cap portion adapted for coupling therewith, the cap portion having an open lower end for coupling with the open upper end of the carrying container, the cap portion having an extended upper end, the extended upper end having an aperture therethrough.

2. A golfing tee system for making the teeing of a golf ball easier and more efficient comprising, in combination:

a plurality of tees of varying lengths, each of the tees having a lower ground penetrating portion, the lower ground penetrating portion having a pointed lower end and an upper end, each of the tees having a circular disk secured to the upper end of the lower ground penetrating portion, each of the tees having an upper cylindrical portion, the upper cylindrical portion having a wide upper portion and a narrow lower portion, the narrow lower portion secured to and extending upwardly from the circular disk, the wide upper portion having a concave upper end, the concave upper end adapted for receiving a golf ball thereon and a carrying container, adapted for holding one of the plurality of tees, having a hollow interior dimensioned for receiving any one of the plurality of tees therein, the carrying container having an open upper end in communication with the hollow interior, the carrying container including a cap portion adapted for coupling therewith, the cap portion having an open lower end for coupling with the open upper end of the carrying container, the cap portion having an extended upper end, the extended upper end having an aperture therethrough.

* * * * *